US005323836A

United States Patent [19]

Tuttle et al.

[11] Patent Number: 5,323,836

[45] Date of Patent: Jun. 28, 1994

[54] MODULAR PORTABLE DISPLAY SCREEN

[75] Inventors: Paul B. Tuttle, Centerville, Utah; William E. Owens, Salem, Oreg.

[73] Assignee: Boise Cascade Corporation, Boise, Id.

[21] Appl. No.: 850,508

[22] Filed: Mar. 13, 1992

[51] Int. Cl.[5] ..... A47G 5/00

[52] U.S. Cl. ..... 160/135

[58] Field of Search ..... 160/135, 351, 352; 40/605, 606, 610, 611; 52/239

[56] References Cited

U.S. PATENT DOCUMENTS

| | | | |
|---|---|---|---|
| 2,882,629 | 4/1959 | Moebius | 40/610 X |
| 2,914,872 | 12/1959 | Goodrich | 40/605 X |
| 2,917,188 | 12/1959 | Menin | 160/135 X |
| 3,113,392 | 12/1963 | Downing | 40/605 |
| 3,571,999 | 3/1971 | Downing | 160/135 X |
| 3,601,916 | 8/1971 | Epstein | 160/135 X |
| 3,913,656 | 10/1975 | Guyer | 160/135 |
| 4,275,520 | 6/1981 | Appleton et al. | 40/605 |
| 4,711,046 | 12/1987 | Herrgord | 160/135 X |
| 4,738,041 | 4/1988 | Drueck | 40/606 X |
| 5,131,448 | 7/1992 | Miller | 160/135 |

*Primary Examiner*—David M. Purol

*Attorney, Agent, or Firm*—Klarquist Sparkman Campbell Leigh & Whinston

[57] ABSTRACT

A portable display system including an array of modular corrugated paperboard panels arranged in a matrix having at least two vertically adjacent rows of panels. Each panel has peripheral flaps folded back to provide strength and to capture threaded fasteners that protrude from the rear of the panels. Attachment hinges engage the fasteners at the rear of the panels to align and join adjacent panels. A vertical reinforcing tube is attachable at each end of the display by passing through holes defined in flaps at the rear of the panels.

23 Claims, 3 Drawing Sheets

MODULAR PORTABLE DISPLAY SCREEN

TECHNICAL FIELD

This invention relates to free standing walls and screens for providing a visual background for trade show booths and the like.

BACKGROUND OF THE INVENTION

Free standing display backdrops are used to provide aesthetic backgrounds for trade show display booths, often carrying printed matter or attached objects for display.

A first type of conventional trade show display is a permanent reusable display designed for long-term usage. These are generally custom fabricated, and are very heavy and durable for frequent reuse. Such displays are very costly to buy and to use. For transport, the displays must be broken down into numerous component parts, which are crated for shipping. In a typical installation, such assemblies must be received at a proper loading dock and constructed by site personnel at a substantial cost. Often, unless an exhibitor's display is hand carried through the front door of a trade show site, the exhibitor may not construct the display, and only venue employees may do so. Accordingly, the large, permanent displays require several extra days between shows to ensure they are shipped, received and constructed in a timely manner.

A second type of conventional display is a lower cost portable display. These are generally designed to be carried by a single person and to be set up without substantial labor costs. An example of such a display is an umbrella-type display having a foldable skeleton across which is suspended a fabric layer. Generally, these displays do not present a high quality, sturdy appearance, particularly in view of the appreciable cost of such displays. Also, such displays are limited in their ability to support attached objects and to be imprinted with various graphic images.

An intermediate display type may provide a better quality appearance than the low cost portable display, but with the disadvantage of reduced portability due to increased weight and bulk. Such displays typically employ hinged hard panels, where each panel is a bulky and expensive assembly of molded plastic parts and laminated surface panels, such as shown in U.S. Pat. No. 4,926,609 to Arico and U.S. Pat. No. 4,147,198 to Ytter. These assemblies require overlays to provide a smooth and contiguous appearance and conceal their thick, exposed edges, and are limited in their ability to be enlarged by the addition of more panel modules.

There is, therefore, a need for a low cost, portable and reusable display screen assembly that has a high-quality, attractive appearance and that is easy to carry and assemble by one person and has the ability to support attached objects.

SUMMARY OF THE INVENTION

Primary objects of the invention are to provide:

A display backdrop suitable for overcoming the disadvantages of the prior art.

A display backdrop as aforesaid which is easily portable, such as by being disassemblable into a set of separate, small, manageable components easily packed and carried by one person in a carrying case.

A display backdrop as aforesaid which may easily be assembled by a single person.

A display backdrop as aforesaid that presents a high quality, uniform, aesthetic appearance.

A display backdrop as aforesaid which is sufficiently sturdy to be self-supporting and capable of carrying attached objects.

A display backdrop as aforesaid which has a surface suitable for printing or application of a wide variety of graphic images.

A display backdrop as aforesaid which is easily fabricated of a lightweight, durable paperboard or other cellulosic fiber sheet material.

A display as aforesaid which is manufacturable at a low cost.

A display as aforesaid which is sufficiently durable for repeated reuse.

According to the present invention, the above objects are achieved by providing a display backdrop having an array of modular corrugated paperboard panels arranged in at least two horizontal rows of such panels. The rows are vertically stacked so that the display height is at least double the individual panel height. The panels are thin, with folded back edges, and are interconnectable with removable hinges. The display is reinforced at each end with a vertical paperboard tube passing through holes formed in foldable flaps on each endmost panel.

The foregoing and additional features and advantages of the present invention will be more readily apparent from the following detailed description which proceeds with reference to the accompanying drawings.

DETAILED DESCRIPTION OF A PREFERRED EMBODIMENT

Figure 1:
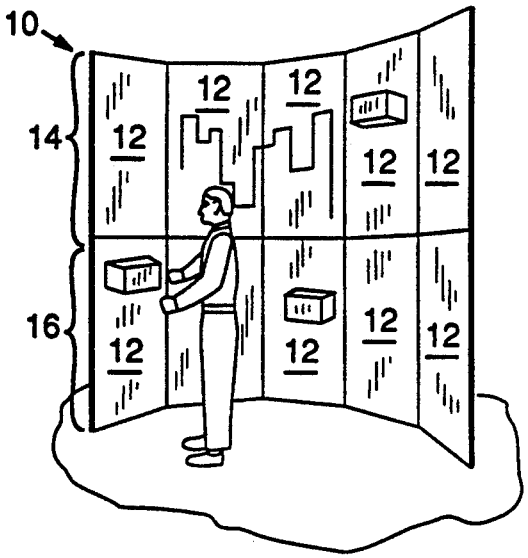
FIG. 1 is a front view of a fully assembled display backdrop according to the present invention.

FIG. 1 shows a free-standing display backdrop 10 formed of an array of vertically-oriented rectangular panels 12 in a vertical, generally curved plane. The panels are arranged in two horizontal rows, with an upper row 14 positioned directly above a lower row 16, which rests on the floor. The panels in each row are attached edge-to-edge, with the rows being attached to each other so that each panel 12 in the upper row 14 is registered with a corresponding panel 12 in the lower row 16. FIG. 1 shows the flat, unbroken front display side of each panel 12.

Figure 2:
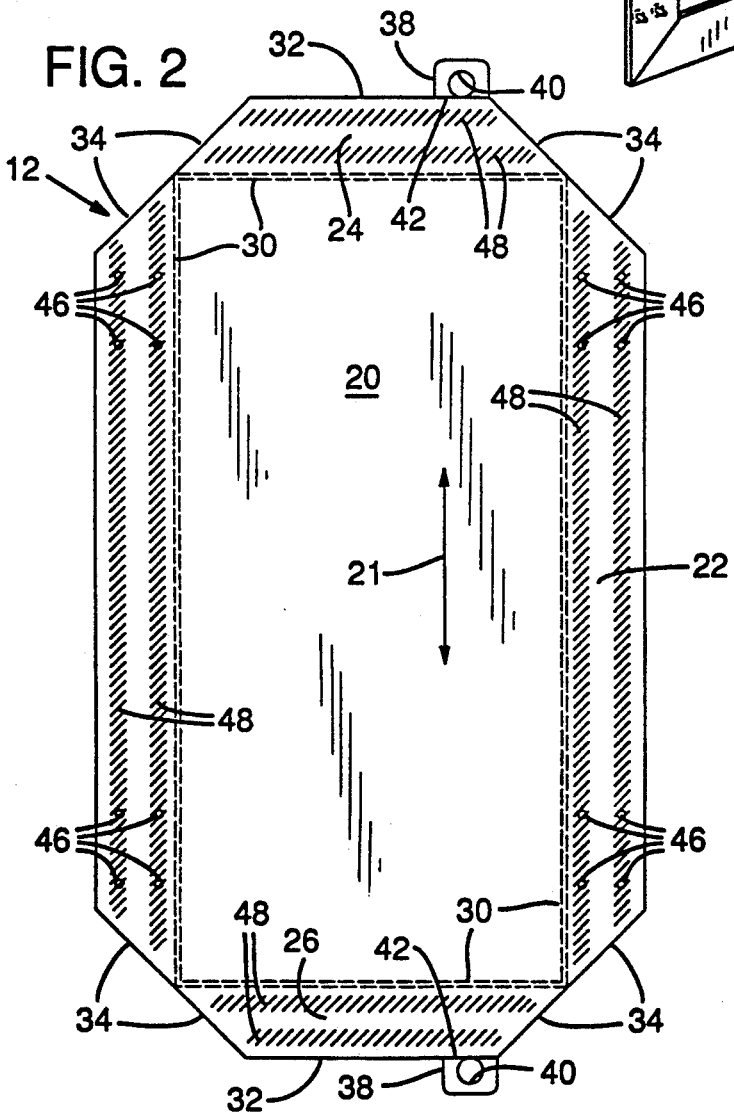
FIG. 2 is a layout drawing of a single panel of the embodiment of FIG. 1.

Each panel 12 is cut from a sheet of double-sided corrugated paperboard stock. FIG. 2. shows the panel 12 in an unformed state, as cut from the paperboard stock. The panel 12 includes an elongated rectangular central panel portion 20 oriented with its long axis parallel to the grain of corrugations 21. This orientation takes advantage of the material strength to provide rigidity on the long axis of the panel 12. The panel 12 includes a pair of integral side flaps 22 at opposite long edges of the central panel portion 20 and integral top flap 24 and bottom flap 26 respectively at the remaining short sides. Each of the flaps is integrally hinged to the central panel portion 20 at a double score line 30 to permit the flaps to be folded back entirely upon the central panel portion 20. Each of the flaps 22, 24 and 26 extends along the full length of its respective panel edge and has an outer edge 32 parallel to the hinge line 30. Each flap is trapezoidal, having flap ends 34 angled at 45 degrees from the hinge line 30 so that the outer edge is substantially shorter than the corresponding hinge line, and to prevent the folded back flaps from overlapping.

A foldable tab 38 is integral with each of the top and bottom flaps 24, 26 joining them at a tab hinge line 42 on the outer edge 32 of the flap. Each tab 38 is similarly offset from the center of the outer edge so that it is proximate to one of the flap ends 34 and directly aligned with the other tab 38. Each tab 38 is generally rectangular and defines a circular hole 40 tangent the tab hinge 42.

Each side flap 22 defines two sets of fastener holes 46. Each set of fastener holes is a rectangularly arrayed group of four, located at one end of the respective side flap 22.

Figure 3:
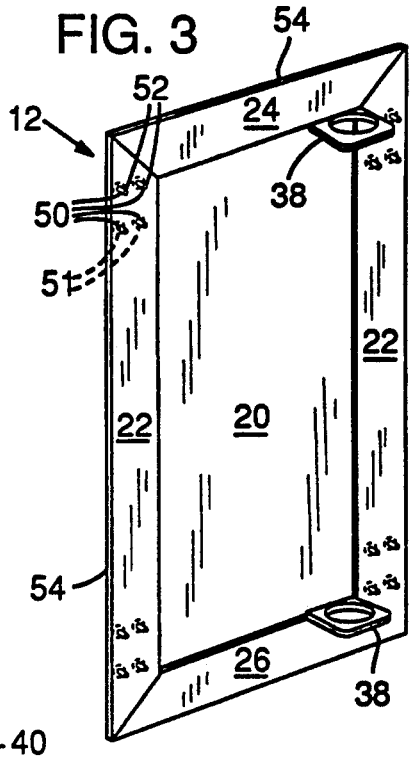
FIG. 3 is a fully constructed panel of the embodiment of FIG. 1.

As further shown in FIG. 2, glue is applied to glued regions 48 located along the length of each flap and corresponding to the locations of the fastener holes 46 to permit the secure adhesion of the flaps in the assembled state shown in FIG. 3. Before the panel 12 is folded and glued to create the fully formed panel shown in FIG. 3, which shows the rear attachment side of the panel 12, a conventional plastic flat-headed threaded fastener 50 is inserted into each of the fastener holes 46. Each fastener has a flat head 51, and a threaded portion 52 protruding perpendicularly therefrom. The fastener head 51 is captured between the central panel portion 20 and the side flap 22 when the panel is formed. The threaded portions 52 protrude perpendicularly from the rear of the formed panel 12. Because the glued regions 48 correspond to the fastener hole locations 46, the fastener heads are secured to prevent their rotation within the fastener holes.

Figure 6:
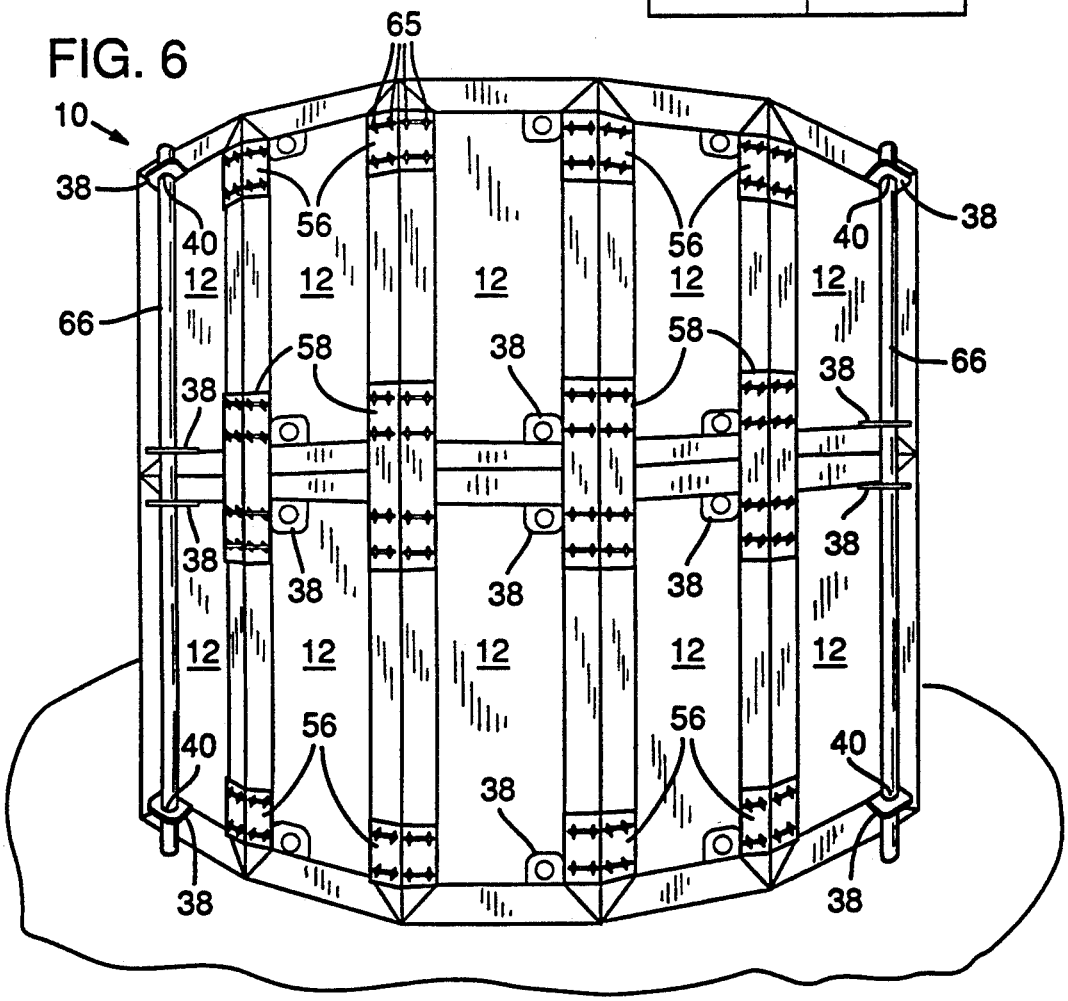
FIG. 6 is a rear view of the embodiment of FIG. 1.

On the four endmost panels 12 of the assembled display shown in FIG. 6, the foldable tabs 38 are folded perpendicular to the central panel portion 20. The remaining tabs 38 are left in their unfolded position. Because of the dual fold lines 30 shown in FIG. 2, the constructed panel 12 shown in FIG. 3 includes a peripheral edge strip 54 neatly spanning between the front surface of the central panel portion 20 and the exposed surface of the side, top and bottom flaps 22, 24 and 26. The edge strip 54 is oriented perpendicularly to the plane of the panel and has a width generally equal to the overall thickness of the assembled panel, including the captured heads of the fasteners 50.

Figure 4:
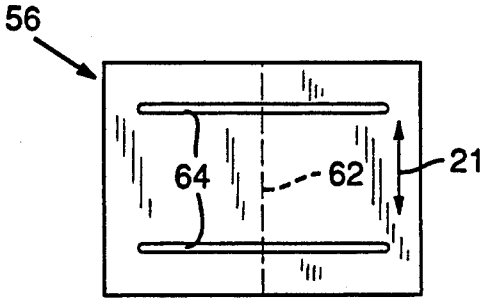
FIG. 4 is a layout drawing of a short attachment hinge of the embodiment of FIG. 1.

As further shown in FIG. 6, the panels 12 are interconnected and aligned by a set of small hinge panels 56 and large hinge panels 58 attached to the display panels 12 by the fasteners 50 at the rear of the display 10. As shown in FIG. 4, the small hinge panel 56 is a rectangular corrugated paperboard sheet that is perpendicularly bisected by a hinge line 62 running parallel to the axis of the corrugations 21 to facilitate controlled bending at the hinge line 62, and to provide strength against bending in other directions. A pair of spaced-apart fastener slots 64 are formed in the hinge panel, oriented perpendicular to the hinge line 62 and bisected thereby. The slots 64 have sufficient width to receive the threaded portion of the fasteners 50 and have sufficient length to accommodate a set of four fasteners 50 from each of two adjacent panels 12, as shown in FIG. 6, and to permit additional adjustment, as will be discussed below.

Figure 5:
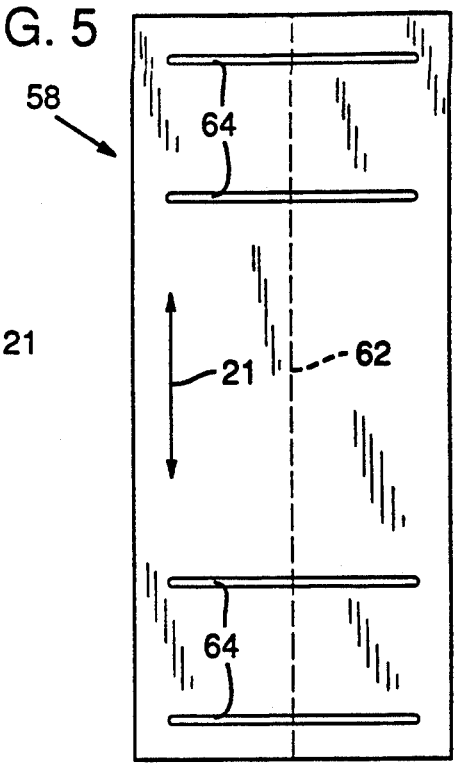
FIG. 5 is a layout drawing of a long attachment hinge of the embodiment of FIG. 1.

FIG. 5 shows the large hinge panel 58, which is a single panel generally equivalent to two small hinge panels joined by a solid central expanse, all on a common hinge line 62. The large hinge 58 has four fastener slots 64 arranged with a pair of such slots at each end of the hinge 58. As shown in FIG. 6, the large hinge panels 58 are each fastened to join a set of four panels 12 that meet at a single corner junction; two adjacent panels in the upper row 14 and two corresponding adjacent panels in the lower row 16. The large hinge 58 receives the lower sets of fasteners on the panels in the upper row and the upper sets of fasteners on the panels in the lower row. The small hinge panels 56 are positioned to receive the upper sets of fasteners in the upper row of panels 12, and to receive the lower sets of fasteners in the lower row of panels 12. To secure the hinge panels 56, 58 to the display panels 12, a conventional plastic wing nut 65 (shown in FIG. 6) substantially wider than the fastener slot 64 is threaded onto each fastener after placement of the hinges to compress the hinge panels against the display panels.

For added vertical stability, and to maintain alignment between the upper and lower panels at the outermost vertical edges of the endmost panels 12 where no hinge may be installed, a smooth, rigid cylindrical paperboard tube 66 is inserted in the holes 40 in the perpendicularly folded tabs 38. Each tube is formed of two mating sections and is sized to closely fit the tab holes 40. The lower end of each tube 66 rests on the floor, with each tube extending the full height of the display.

Figure 7:
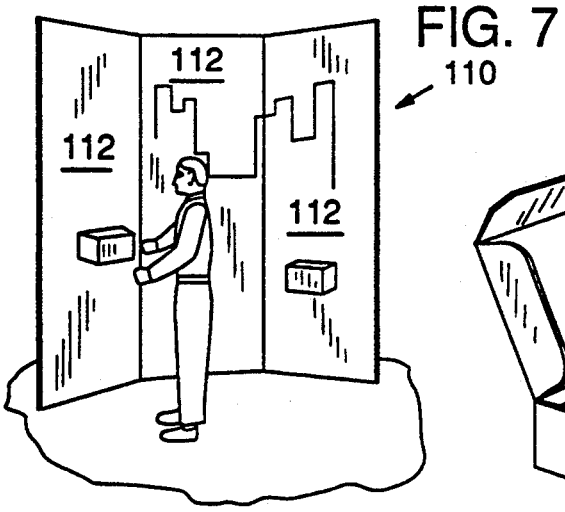
FIG. 7 is a front view of an alternative embodiment display backdrop.
Figure 8:
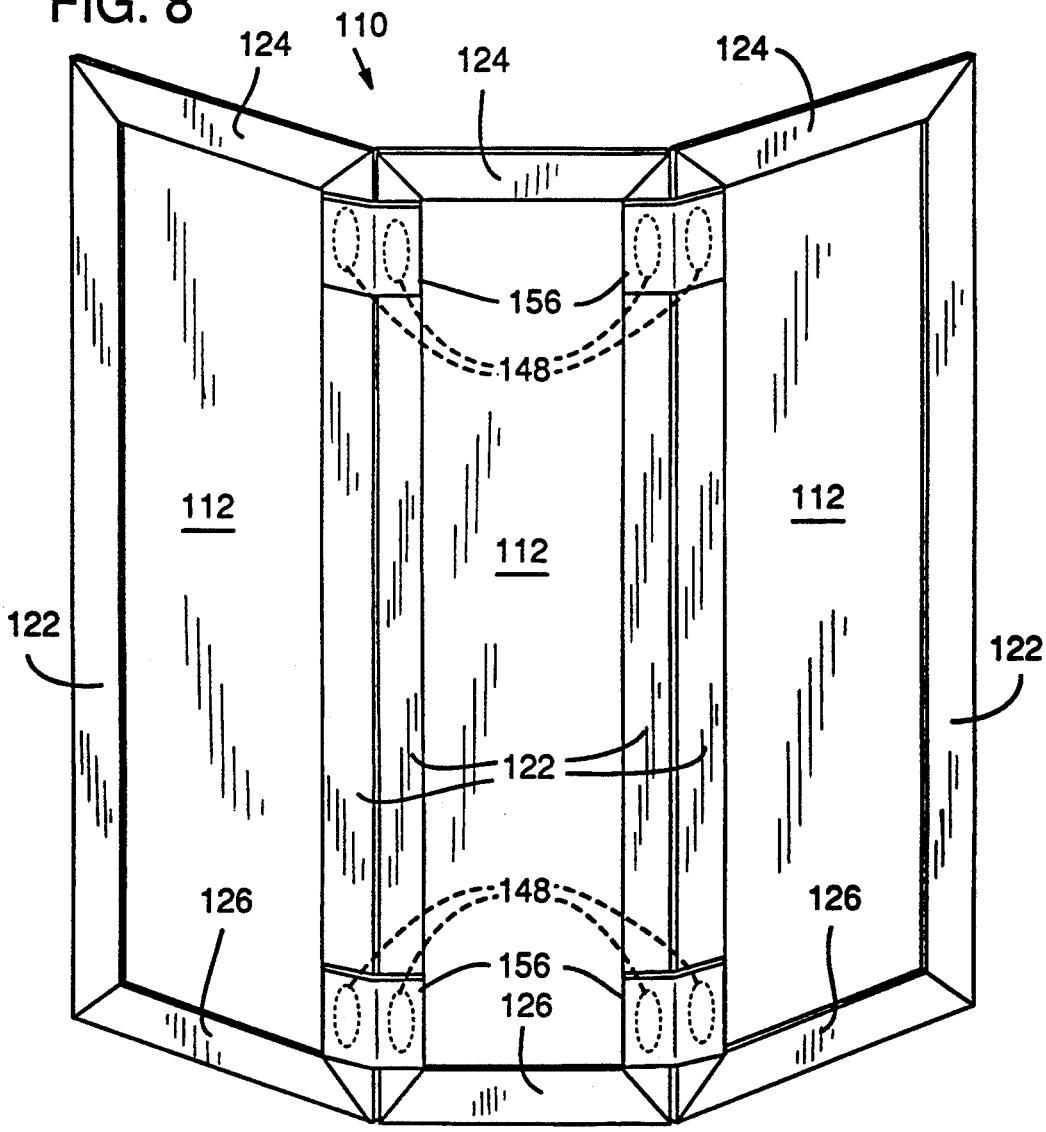
FIG. 8 is a rear view of the embodiment of FIG. 7.

A simplified alternative embodiment display 110 is shown in FIGS. 7 and 8, and incorporates only three full-height panels 112. Like the modular panels 12 of the preferred embodiment, each panel 112 includes a top flap 124, a bottom flap 126 and opposed side flaps 122 to provide a structurally reinforced panel with sturdy and attractive edges. Instead of removable hinge panels, the alternative display 110 includes at least a pair of vertically spaced-apart hinges 156 at each vertical junction between adjacent panels 112. The hinges 156 are simple rectangular paperboard sheets adhered with glue 148 to the rear of the panels 112 to provide a secure junction. The alternative embodiment display 110 may be quickly and affordably assembled on site from available raw materials, such as corrugated paperboard panels, as opposed to the pre-cut and assembled corrugated paperboard panels 12 of the preferred embodiment. The alternative embodiment display 110 is not intended to be disassemblable, although removable hinges may be substituted for glued hinges to make it so.

EXAMPLE

In the preferred embodiment, the modular panels 12 are 2 feet wide by 4 feet high, resulting in overall display dimensions of 8 feet high by 10 feet wide. The panel is formed of two-sided corrugated paperboard having a thickness of approximately $\frac{1}{8}$ inch, for an overall panel thickness of $\frac{1}{4}$ inch at the periphery of each panel. The panels may be pre-printed, coated or laminated with a washable material such as vinyl sheeting. The plastic fasteners 50 include a $\frac{3}{8}$ inch long threaded portion to fit a $\frac{1}{4}$-20 wing nut. The alignment tubes 66 are formed of paperboard in 4 foot long sections and have an outside diameter of $1\frac{5}{8}$ inch. A short length, closely-fitting junction paperboard tube glued in the end of one section joins the two sections of each tube.

Figure 9:
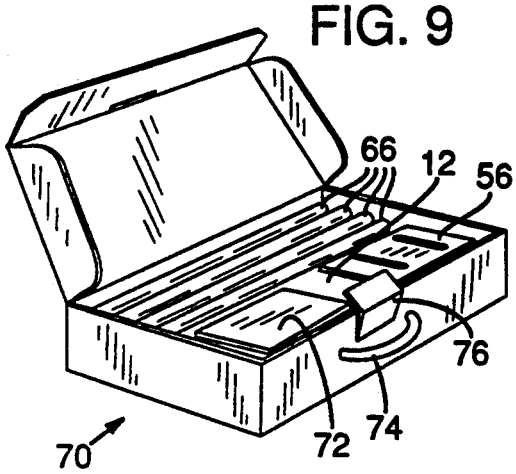
FIG. 9 is a perspective view of an assembled paperboard carrying case containing a disassembled display backdrop according to the embodiment of FIG. 1.

The preferred embodiment generally includes a corrugated paperboard carrying case 70 (shown in FIG. 9), which is sized to closely fit a stack of the panels 12, with the remaining hinges 56, 58, tube sections 66, and a carton 72 for other hardware fitting on top of the panels in the case. With an attached handle 74 and latches or locking tab 76 to secure the carrying case, the overall case dimensions may be less than 49 inches long, 25 inches high, and $7\frac{1}{2}$ inches thick to facilitate convenient transport either by itself or in a conventional paperboard shipping carton. The carrying case and contents may be enclosed in a shipping carton to prevent damage during transport.

ASSEMBLY

One person may assembly the display by laying out the panels 12 face down in the orientation desired for assembly. The hinges 56, 58 are then placed into position over the fasteners 50 and secured with the wing nuts 65. If the display will be arranged in the concave configuration shown in FIG. 1, a small gap should be left between laterally adjacent panels to accommodate curvature of the display without crushing the panel edges. The assembler then inserts the tube sections into the foldable tab holes 40 and mates the sections to form a complete tube 66 at each edge of the display. The display may be raised to an upright position, whereupon it may be curved to its desired configuration. If a convex curvature is desired, the assembler may readjust the hinge fasteners to eliminate any gaps between panels.

While the display is shown in the preferred embodiment as having two rows of five panels, it is contemplated that any number of rows or columns may be constructed. It is further contemplated that more than one display kit of the first embodiment may be used in a single construction to create a substantially larger structure, such as a long, sinuous divider wall. It is also contemplated that the display may be used in two single height sections, with on section resting at the rear of a display table, and the other in front of the table.

Thus, having illustrated and described the principles of the invention by what is presently a preferred embodiment, it should be apparent to those persons skilled in the art that the illustrated embodiment may be modified without departing from such principles. We claim as our invention not only the illustrated embodiment, but all such modifications, variations and equivalents thereof as come within the true spirit and scope of the following claims.

We claim:

1. A portable display system comprising:

a plurality of separate panels each formed from a single sheet of panel material, and each panel having a front side suitable for display and an opposed rear side;

attachment means for attaching the panels in an array of at least two rows of panels, each row comprising a plurality of panels in lateral edge-to-edge relation, and for attaching the rows in vertically stacked relation, the attachment means further including a flexible portion to permit laterally adjacent panels to be angularly disposed with respect to each other, and including adjustment means for adjusting the spacing between adjacent panels to provide a gap-free edge-to-edge relationship between adjacent panels.

2. The system of claim 1 wherein the panel material is corrugated cellulosic fiber sheeting.

3. The system of claim 1 wherein the panel material is paperboard.

4. The system of claim 1 wherein each panel is a folded sheet of material.

5. The system of claim 4 wherein each panel includes a central panel portion having a periphery defined by a plurality of fold lines, and a set of peripheral flaps integral with the central panel portion at the fold lines and folded back thereupon such that the panel presents an attractive and sturdy edge on all edges.

6. The system of claim 5 including a fastener having a captured portion between the central panel portion and the peripheral flap.

7. The system of claim 6 wherein the captured portion is a flat head.

8. The system of claim 1 wherein the attachment means comprises a fastener having a fastening portion protruding from the panel rear.

9. The system of claim 1 wherein the attachment means comprises hinges attachable to and removable from the panel rear sides, such that the display system may be readily disassembled.

10. The system of claim 9 wherein the hinges comprise flat sheets of material.

11. The system of claim 10 wherein the hinges and the panels comprise the same material.

12. The system of claim 9 wherein the panels include protruding fasteners, and the hinges define elongated slots for slidably receiving the fasteners so that the panels are laterally adjustable to allow the adjacent panels to shift such that gaps between the panels may be eliminated.

13. The system of claim 1 including a reinforcing member attachable to a pair of vertically adjacent panels at a free edge of the array such that the pair is secured as a unit.

14. The system of claim wherein the reinforcing member is a tube having a length substantially coextensive with the height of the display.

15. The system of claim 13 wherein at least some of the panels include foldable tabs each having a hole defined therein suitable for receiving the reinforcing member.

16. A freestanding display screen comprising:

a plurality of upstanding rectangular panels each having a front display side and a rear attachment side, the panels arranged in laterally adjacent edge-to-edge relationship in a row without gaps between the panels; and a plurality of attachment hinges for joining the panels together in edge-to-edge relationship, each of said hinges comprising a generally flat sheet removably attached to the adjacent edges of two adjacent panels to form a hinged junction therebetween such that the panels may be arranged in angular relationship to one another to provide a continuous freestanding screen and may be disconnected from one another at their hinges for disassembly and transport of the screen.

17. The screen of clam 16 wherein at least some of the panels comprise paperboard sheets.

18. The screen of claim 16 wherein each panel includes peripheral flaps folded back and attached to the panel rear to provide strengthened panel edges.

19. A panel module for a modular portable display system comprising:

a single sheet of panel material having a front side suitable for display and an opposed rear side, the panel including a central panel portion and a set of peripheral flaps integral with and joined to the central panel portion at fold lines defining the peripheral edges of the central panel portion and folded back against the rear side and joined thereto in face-to-face relationship at a second location on the central panel portion apart from the fold line to provide the panel module with a reinforced marginal edge portion of increased thickness.

20. The panel of claim 19 wherein the panel material is corrugated sheeting.

21. The panel of claim 19 wherein the panel material is paperboard.

22. The panel of claim 19 including a fastener having a captured portion between the central panel portion and the peripheral flap.

23. The panel of claim 19 including a fastener having a fastening portion protruding from the panel rear.

* * * * *